US009909367B2

(12) United States Patent
Eddison et al.

(10) Patent No.: US 9,909,367 B2
(45) Date of Patent: Mar. 6, 2018

(54) DOWNHOLE TOOL WITH ROTATIONAL DRIVE COUPLING AND ASSOCIATED METHODS

(71) Applicant: NOV Downhole Eurasia Limited, Gloucestershire (GB)

(72) Inventors: Alan Martyn Eddison, York (GB); Rory McCrae Tulloch, Abderdeen (GB)

(73) Assignee: NOV Downhole Eurasia Limited (GB)

( * ) Notice: Subject to any disclaimer, the term of this patent is extended or adjusted under 35 U.S.C. 154(b) by 371 days.

(21) Appl. No.: 14/424,439

(22) PCT Filed: Aug. 29, 2013

(86) PCT No.: PCT/GB2013/052275
§ 371 (c)(1),
(2) Date: Feb. 26, 2015

(87) PCT Pub. No.: WO2014/033462
PCT Pub. Date: Mar. 6, 2014

(65) Prior Publication Data

US 2015/0226015 A1 Aug. 13, 2015

(30) Foreign Application Priority Data

Aug. 29, 2012 (GB) ..... 1215345.8

(51) Int. Cl.
*E21B 7/06* (2006.01)
*E21B 17/10* (2006.01)
(Continued)

(52) U.S. Cl.
CPC ..... *E21B 17/00* (2013.01); *E21B 3/00* (2013.01); *E21B 7/06* (2013.01); *E21B 7/062* (2013.01); *E21B 7/067* (2013.01); *E21B 17/1078* (2013.01)

(58) Field of Classification Search
CPC . E21B 7/067; E21B 7/06; E21B 7/062; E21B 7/068; E21B 17/00; E21B 17/1078
(Continued)

(56) References Cited

U.S. PATENT DOCUMENTS 5,743,335 A 4/1998 Bussear
6,092,610 A 7/2000 Kosmala et al.
(Continued)

FOREIGN PATENT DOCUMENTS

EP 2381062 10/2011
GB 2343470 10/2000
RU 2441125 1/2012

OTHER PUBLICATIONS

Search Report for GB Patent Application No. 1215345.8 dated Oct. 9, 2012, 2 pages.
(Continued)

*Primary Examiner* — George S Gray
(74) *Attorney, Agent, or Firm* — Conley Rose, P.C.

(57) ABSTRACT

A downhole tool (10) comprising rotatable inner and outer sleeves (62, 63). The sleeves (62, 63) comprise coupling portions for transmitting a torque between the sleeves (62, 63). The tool is reconfigurable between a first configuration whereby the coupling portions are axially misaligned to prevent transmission of torque between the inner and outer sleeves (62, 63), and a second configuration whereby the coupling portions are axially aligned to permit a transmission of torque between the sleeves (62, 63). At least one of the coupling portions is configured to prevent the transmission of torque above a predetermined torque threshold.

33 Claims, 10 Drawing Sheets

(51) Int. Cl.
*E21B 17/00* (2006.01)
*E21B 3/00* (2006.01)

(58) Field of Classification Search
USPC ..... 175/61, 107, 74, 73, 92, 101, 320; 166/237; 464/18, 19
See application file for complete search history.

(56) References Cited

U.S. PATENT DOCUMENTS

| | | | | |
|---|---|---|---|---|
| 6,321,857 | B1 | 11/2001 | Eddison | |
| 7,287,607 | B1 * | 10/2007 | Falgout, Sr. | E21B 7/062 166/237 |
| 2001/0047884 | A1 | 12/2001 | Eddison | |
| 2007/0181343 | A1 | 8/2007 | Russell et al. | |
| 2011/0140411 | A1 | 6/2011 | Marchand | |
| 2011/0240313 | A1 | 10/2011 | Knobloch, Jr. et al. | |

OTHER PUBLICATIONS

International Search Report and Written Opinion for PCT Patent Application No. PCT/GB2013/052275 dated Aug. 8, 2014, 9 pages.
Further Search Report for GB Patent Application No. 1215345.8 dated Mar. 13, 2013, 1 page.

* cited by examiner

SECTION A-A

SECION B-B

DOWNHOLE TOOL WITH ROTATIONAL DRIVE COUPLING AND ASSOCIATED METHODS

CROSS-REFERENCE TO RELATED APPLICATION

This application is a national phase application of PCT Application No. PCT/GB2013/052275 which claims the benefit of GB Patent Application No. 1215345.8, filed on Aug. 29, 2012, the entire contents of which are hereby incorporated by reference.

FIELD OF THE INVENTION

The present invention relates to a downhole tool with a rotational drive coupling and associated methods; in particular, but not exclusively, to a rotational drive coupling for selectively rotating a portion of a downhole tool, such as a portion of a directional drilling apparatus.

BACKGROUND TO THE INVENTION

In downhole operations, such as in bores for reservoirs (e.g. oil and gas reservoirs), downhole tools are often required to be rotated, such as for drilling the bore.

In some operations rotation is temporarily or selectively transmitted downhole. For example, in directional or controlled trajectory drilling, a steering portion of the downhole tool may be rotated only when the direction of drilling is changed; whilst the drill bit may be rotated more of the time.

In directional drilling, the vertical inclination and azimuth of a drilled bore may be controlled such that the bore may extend from the surface to a target area which is not vertically aligned with the point on the surface where drilling commences. This permits a wide area to be accessed from a single drilling location and is therefore particularly useful in offshore drilling operations.

Applicant's GB 2,343,470 and U.S. patent application Ser. No. 09/435,453, and also WO97\47848 and U.S. patent application Ser. No. 09/202,342 and U.S. patent application Ser. No. 10/470,031, the disclosures of which are incorporated herein by reference, describe arrangements including non-rotating offset masses to provide a desired offset of the drill string in the bore.

In some downhole operations there can be changes in the transmission of rotational drive that result in a driven component being inadvertently coupled or decoupled; or coupled or decoupled under undesirable conditions. For example, where a drive coupling is controlled by a fluid pressure or a fluid pressure differential, the driven component may be inadvertently coupled by an unplanned change in fluid pressure (e.g. if a pump fails). Undesirably transmitting drive to components can potentially damage the driven components or other parts of the downhole tool or associated equipment; or cause delay or impede operations.

It is among the objectives of at least one embodiment of at least one aspect of the present invention to seek to obviate or at least mitigate one or more problems and/or disadvantages of the prior art.

SUMMARY OF THE INVENTION

According to an aspect of the invention there is provided a downhole tool. The downhole tool may comprise a rotatable inner sleeve comprising an inner sleeve coupling portion. The downhole tool may comprise a rotatable outer sleeve mounted coaxially with the inner sleeve and comprising an outer sleeve coupling portion for engagement with the inner sleeve coupling portion for transmitting a torque between the inner and outer sleeves. The tool may be reconfigurable between a first configuration whereby the transmission of torque between the inner and outer sleeves is prevented, and a second configuration whereby the transmission of torque between the inner and outer sleeves is permitted. At least one of the inner or outer sleeve coupling portions may be configured to prevent the transmission of torque above a predetermined torque threshold when the tool is in the second configuration.

Providing such a downhole tool may permit the selective transmission of torque within a predetermined torque range. The selective transmission of torque may permit the selective rotation of at least one of the sleeves. Preventing the transmission of torque above a predetermined threshold when the coupling portions are axially aligned may prevent damage to the tool or associated equipment. For example, the torque threshold may be related to or determined by a mechanical property (e.g. a strength, a stiffness Young' modulus, or an impact resistance or the like) of one of the sleeves or a mechanical property of a member connected or associated with one of the sleeves (e.g. the level of the torque threshold may be selected to prevent a connected part or member experiencing an excessive force, pressure or stress that could otherwise damage the connected part or member). It will be appreciated that torque may comprise a torque differential, such as a torque differential between the inner and outer sleeves.

The inner and outer sleeve coupling portions may be axially misaligned in the first configuration to prevent transmission of torque between the inner and outer sleeves in the first configuration. The inner and outer sleeve coupling portions may be axially aligned in the second configuration to permit the transmission of torque between the inner and outer sleeves in the second configuration.

At least one of the inner or outer sleeve coupling portions may be configured to prevent engagement of the coupling portions above the predetermined torque threshold.

The tool may be configured to allow or enable engagement and/or re-engagement of the coupling portions, such as when the torque falls below the predetermined threshold. The tool may be configured to engage and/or re-engage the coupling portions, such as when the torque falls below the predetermined threshold. The coupling arrangement may be configured to allow or enable the transmission or retransmission of torque when the torque falls below the predetermined threshold. The at least one of the inner or outer sleeve coupling portions may be configured to enable the transmission or retransmission of torque when the tool is in the second configuration and the torque falls below the predetermined threshold.

The tool may be reconfigurable between the first and second configurations without requiring rotational alignment of the inner and outer sleeve coupling portions. The inner and outer sleeve coupling portions may automatically engage or re-engage in the second configuration when the torque is or falls below the predetermined torque threshold. The coupling portions may be engageable substantially independently of relative rotational positions of the inner and outer sleeves.

The coupling portions may be self-aligning. The coupling portions may be automatically rotationally aligned. The coupling portions may be configured to automatically engage in the second configuration when the inner and outer sleeves rotate relative to each other, with the torque below the torque threshold. The coupling portions may be configured to automatically engage when the tool is reconfigured from the first configuration to the second configuration.

At least one of the inner or outer sleeve coupling portions may be configured to disengage the coupling portions at the predetermined torque threshold.

At least one of the inner or outer sleeve coupling portions may be configured to disengage the other of the outer or inner sleeve coupling portion on exceeding the predetermined torque threshold.

The inner and outer sleeve coupling portions may form a coupling arrangement for transmitting the torque between the inner and outer sleeves. The coupling arrangement may be interengaging. The coupling arrangement may be configured to displace at least one of the coupling portions in response to the predetermined torque. The coupling arrangement may be configured to substantially radially displace at least one of the coupling portions in response to the predetermined torque. The coupling arrangement may be configured to substantially axially displace at least one of the coupling portions in response to the predetermined torque. The coupling arrangement may comprise no discrete spring components. For example, the coupling arrangement may be configured to engage and disengage without a spring (e.g. a torsional, helical or coil spring). A discrete spring component may provide a potential mechanical weakness and/or a tolerance problem and/or a susceptibility to debris impediment and/or an assembly or repair issue. A discrete spring component may be more prone to tilting or jarring, such as under high impact.

The coupling arrangement may comprise a torque limiter.

At least one of the inner or outer sleeve coupling portions may be configured to convert at least a portion of the torque into a directional force in a direction other than that of rotation. The portion of torque may be a portion of tangential force associated with the torque. The directional force may be a substantially non-tangential force. The directional force may be a substantially lateral force. The directional force may be a substantially radial force. At least one of the inner or outer sleeve coupling portions may be configured to convert a predetermined portion of the torque into a directional force. A magnitude of the directional force may vary proportionately with the torque. The directional force may comprise a disengaging force at a predetermined magnitude.

The/each coupling portion may comprise a bearing (or drive contact) surface for contacting the other coupling portion to transfer torque between the sleeves. The/each bearing surface may be configured to be substantially transverse to the direction of rotation. The/each bearing surface may be configured to be substantially perpendicular to the direction of rotation. The/each bearing surface may be configured to be non-perpendicular (e.g. off-perpendicular) to the direction of rotation. The/each bearing surface may be non-perpendicular to the sleeve. The/each bearing surface may be arranged at an offset angle. The offset angle may be relative to a plane perpendicular to the direction of rotation. The offset angle may be relative to a radius of the sleeve. The offset angle may be relative to a plane defined by a central longitudinal axis of the sleeve and a radius of the sleeve. The offset angle may be predetermined. The offset angle may correspond to a particular torque threshold. The torque threshold may be at least partially defined by the offset angle. The offset angle may provide for a radial movement of the bearing surface/s at the predetermined torque. The radial movement may be outwards. The radial movement may be inwards. Additionally, or alternatively, the offset angle may provide for an axial movement of the bearing surface/s at the predetermined torque. The offset angle may be such as to not allow unlimited torque transmission.

The/each coupling portion may be configured to be substantially unaffected by a rotational speed, such as a rotational speed within an operational range. For example, the/each coupling portion may be configured to be substantially undeflected or undisplaced by a centrifugal force associated with an operational rotational speed. Additionally, or alternatively, each coupling portion may be configured to displace or deflect outwards by a similar distance at a same rotational speed. Accordingly, the coupling portions may remain engaged with each other within an operational speed range.

Alternatively, the/each coupling portion may be configured to selectively disengage outwith an operational rotational speed range. For example, one coupling portion may be configured to displace or deflect outwards more than the other coupling portion at a same rotational speed. Accordingly, the coupling portions may be disengaged outside an operational speed range.

The/each coupling portion may be configured to transmit torque in only one direction (e.g. only clockwise or only counter-clockwise). The/each coupling portion may comprise a plurality of bearing surfaces for transmitting torque in the single direction.

Alternatively, the/each coupling portion may be configured to transmit torque in more than one direction (e.g. clockwise and counter-clockwise). The/each coupling portion may comprise a plurality of bearing surfaces for transmitting torque in more than one direction.

The plurality of bearing surfaces may be distributed around the respective coupling portion/s. The distribution may be even (e.g. each bearing surface may be equidistant in each direction from a next adjacent bearing surface). An even distribution of the plurality of bearing surfaces may allow for a balanced transmission of torque (e.g. about a central longitudinal axis of the tool).

The bearing surfaces may be configured to slide relative to each other. The bearing surfaces may be configured to slide relative to each other at the predetermined torque. The bearing surfaces may comprise a friction property such that the bearing surfaces slide relative to each other at the predetermined torque. The friction property may comprise a coefficient of friction. The friction property may comprise a surface roughness of at least one of the bearing surfaces. The friction property may comprise a surface energy property. The friction property may comprise a lubrication property. The lubrication may be provided by a lubricant. The apparatus may comprise a lubricant reservoir for lubricating the bearing surface/s. The tool may comprise a fluid chamber housing the bearing surfaces. The fluid chamber may house the bearing surfaces in a lubricant oil reservoir. The fluid chamber may be sealed, such as sealed from a drilling fluid and/or a wellbore fluid. Alternatively, the lubrication property may be provided by an actuation fluid, such as a drilling fluid. The torque threshold may be at least partially defined by the friction property.

The/each coupling portion may be configured to move relative to a respective sleeve body portion. For example, the outer sleeve coupling portion may be configured to move substantially radially relative to an outer sleeve body portion.

At least one of the coupling portions may be fixed relative to the respective sleeve. For example, the inner sleeve coupling portion may be fixed relative to an inner sleeve body portion.

At least one of the coupling portions may comprise a longitudinal element. The longitudinal element may comprise the bearing surface. The longitudinal element may comprise a longitudinal member. The longitudinal element may comprise a finger. The longitudinal element may comprise a collet finger. The longitudinal element may comprise a slot. The longitudinal element may comprise a spline.

At least a portion of the longitudinal element may be configured to deflect or displace in a substantially non-axial direction relative to the sleeve. The longitudinal element may comprise a longitudinal axis in a direction of the longitudinal element's primary dimension. The longitudinal element may be configured to deflect or displace transverse to the element's longitudinal axis. The longitudinal element may be configured to deflect or displace such that the coupling portions disengage. The longitudinal element may be configured to deflect or displace such that the coupling portions disengage at the predetermined torque.

The longitudinal element may be configured to deflect or displace substantially transverse to the longitudinal axis of the sleeve. The longitudinal element may be configured to deflect or displace substantially transverse to the sleeve. The longitudinal element may be configured to deflect or displace substantially radially. The longitudinal element may be configured to deflect or displace substantially radially at the predetermined torque threshold. The longitudinal element may be resilient. Providing a resilient longitudinal member may permit re-engagement of the coupling portions, such as when the torque drops below the predetermined threshold. The longitudinal element may be elastic. The longitudinal element may be longitudinally arranged relative to the sleeve, such as substantially parallel to the central longitudinal axis of the sleeve. The longitudinal element may be substantially axially arranged. The longitudinal element may be substantially straight. The longitudinal element may be substantially curved in at least one direction. Longitudinally arranging the longitudinal element may permit an increased length of the longitudinal element. The longitudinal element may be substantially circumferentially arranged, such as substantially around a circumference of the sleeve. Circumferentially arranging the longitudinal element may permit a reduced overall length of the sleeve. The longitudinal element may be axially and/or circumferentially arranged. The longitudinal element may be helically arranged. Helically arranging the longitudinal element may permit an increased length of longitudinal element and/or a reduced total length of sleeve.

The longitudinal element may comprise a stiffness. The torque threshold may be at least partially defined by the stiffness of the longitudinal element.

Providing a longitudinal element may prevent the transmission of torque above the predetermined threshold substantially independently of the configuration of the tool. For example, where the tool is reconfigurable between the first and second configurations by an axial movement, a substantially non-axial movement of at least one of the coupling portions in response to a torque above the predetermined threshold may permit the coupling portions to disengage irrespective of the axial movement. Providing a longitudinal element configured to deflect or displace transverse to the element's longitudinal axis may permit a transverse displacement of the bearing surface over a distance at a substantially constant resistance force (e.g. at least partially caused by a stiffness of the longitudinal element). The distance may be sufficient to permit engagement or disengagement of the coupling portions.

The longitudinal element may be connected to the body portion of the sleeve. The longitudinal element may be configured to deflect or displace relative to the body portion. The longitudinal element may be connected to a body portion of the sleeve at a first end portion. The first end portion may be fixed to the sleeve body portion.

The longitudinal element may be unconnected at a second end portion. The second end portion may be configured to displace relative to the sleeve body portion. The bearing surface may be located at the second end portion of the longitudinal element.

Alternatively, the longitudinal element may be connected to the body portion of the sleeve at the second end portion. The second end portion may be fixed to the sleeve body portion. The bearing surface may be located at an intermediate portion of the longitudinal element between the first and second end portions.

The bearing surface may be located at a portion of the longitudinal element configured for maximum deflection or displacement at the predetermined torque.

The/each coupling portion may comprise a protrusion. The protrusion may extend radially relative to the sleeve and/or longitudinal element. The protrusion/s may comprise the bearing surface/s.

The/each coupling portion may comprise a recess. The recess/es may comprise the bearing surface/s.

One of the inner or outer coupling portions may comprise a protrusion and the other of the outer or inner coupling portions may comprise a corresponding recess.

The inner and/or outer sleeve coupling portion/s may be integrally formed with the respective sleeve. For example, the longitudinal element may be integrally formed with the body portion. Integrally forming the coupling portion with the sleeve may prevent or reduce stresses and/or impact and/or torque losses and/or increase allowable positioning and/or manufacturing tolerances. For example, an alternative sleeve with a non-integral coupling portion may require an interface between the sleeve and the coupling portion, the additional interface potentially influencing the absolute value and/or accuracy of the predetermined torque.

The each/sleeve may comprise a plurality of coupling portions. For example, the/each sleeve may comprise a plurality of coupling portions distributed around the sleeve. The plurality of coupling portions may be evenly distributed around a circumference of the sleeve. Providing a plurality of coupling portions may provide for a balanced transmission of torque about the central longitudinal axis.

The sleeve body portion may extend adjacent the longitudinal element. The sleeve body portion may extend in a longitudinal portion between adjacent longitudinal elements. The body portion may be stiffer than the longitudinal element. The body portion may be thicker than at least a portion of the longitudinal element. The body portion may be distanced from the longitudinal element by a separation. The separation may permit movement of the longitudinal element relative to the sleeve body portion (e.g. radial deflection or deformation). The separation may be circumferential. Alternatively, or additionally, the separation may be axial. The sleeve may be configured to disengage at the predetermined torque prior to closing of the separation by movement of the longitudinal element (e.g. deflection or deformation of the longitudinal element). The longitudinal element may be stiffer in a direction of rotation than in the direction of deflection or deformation. For example, the longitudinal element may comprise a greater thickness in the direction of rotation (e.g. circumferential direction) than in the direction of deflection or deformation. The longitudinal element may comprise a greater stiffness in a direction of rotation than in the direction of deflection or deformation. The longitudinal element may comprise a greater torsional stiffness than a radial and/or an axial stiffness. The longitudinal element may comprise a greater axial stiffness than a radial stiffness. A deflection distance to engage or disengage the coupling portion may be greater than the separation.

The sleeve body portion may be arranged axially adjacent the longitudinal element. The sleeve body portion may be arranged circumferentially adjacent the longitudinal element.

The downhole tool may comprise a steerable tool. The tool may be steerable by the selective transmission of torque between the inner and outer sleeve coupling portions.

The downhole tool may comprise a drilling tool. The downhole tool may comprise a directional drilling tool. The tool may comprise a longitudinal body. The longitudinal body may comprise a throughbore. The tool may comprise a downhole drilling assembly (e.g. including a bottom hole assembly with a drill bit).

The downhole tool may comprise a reaming or underreaming tool.

The tool may be reconfigurable between the first and second configurations in response to a signal. The tool may be reconfigurable between the first and second configurations in response to a change in fluid pressure. The tool may be reconfigurable between the first and second configurations in response to a change in differential fluid pressure.

The/each sleeve may be configured to transmit rotation to/from an additional component. For example the sleeve may comprise an additional coupling for transmitting torque to the additional component.

The coupling arrangement may be configured to selectively transfer torque between a drilling drive system and a drilling steering system.

The sleeve may comprise a mandrel. The sleeve may comprise a throughbore.

The torque threshold may be at least partially determined by a mechanical property of at least one of the sleeves or a mechanical property of a member connected or associated with one of the sleeves. For example, the torque threshold may be at least partially related to or partially determined by a strength and/or a stiffness (e.g. Young's modulus) and/or an impact resistance of a driven component (e.g. the level of the torque threshold may be selected to prevent a the driven component experiencing an excessive force, pressure or stress that could otherwise damage the driven component).

The torque may be transmitted from a downhole source, such as a downhole motor (e.g. a fluid-actuated motor). The torque may be transmitted from an uphole source, such as a surface motor (e.g. by rotation of a string or tubing). The torque may comprise an absolute torque. The torque may comprise a relative torque (e.g. a differential torque between the inner and outer sleeves).

According to an aspect of the invention there is provided a method of selectively transmitting torque between an inner sleeve and an outer sleeve of a downhole tool, the method comprising:

configuring the downhole tool to a first configuration wherein respective coupling portions of the inner and outer sleeves are axially misaligned to prevent transmission of torque between the inner and outer sleeves;

reconfiguring the downhole tool to a second configuration wherein the respective coupling portions of the inner and outer sleeves are axially aligned to permit transmission of torque between the inner and outer sleeves; and preventing the transmission of torque above a predetermined torque threshold when the tool is in the second configuration.

The method may comprise engaging the coupling portions in the second configuration to transmit torque.

The method may comprise disengaging the coupling portions at the predetermined torque.

The method may comprise re-engaging the coupling portions when the torque falls below the predetermined torque. The method may comprise automatically re-engaging the coupling portions when the torque falls below the predetermined torque.

The method may comprise reconfiguring the downhole tool to a third configuration, wherein the respective coupling portions of the inner and outer sleeves are axially misaligned in a substantially opposite axial orientation. For example, where the outer sleeve coupling portion is axially positioned above the inner sleeve coupling portion in the first configuration, the outer sleeve coupling portion may be axially positioned below the inner sleeve coupling portion in the third configuration (or vice versa).

The method may comprise reconfiguring the tool by varying a fluid pressure. For example, the tool may be reconfigured from the first configuration to the second configuration by reducing fluid pressure within the tool. Accordingly, torque may be selectively transmitted (e.g. to steer the tool) when a fluid pressure is reduced. Torque may be selectively transmitted when less fluid and/or less fluid pressure may be required (e.g. when an operation, such as drilling, is reduced).

The method may comprise reconfiguring the downhole tool to the third configuration to establish a predetermined relative position of the outer sleeve with respective to the inner sleeve. The method may comprise resetting a datum by reconfiguring the downhole tool to the third configuration. Reconfiguring the tool to the third configuration may comprise aligning a rotatable portion with a drive portion. Reconfiguring the tool to the third configuration may comprise misaligning the rotatable portion with the drive portion by a predetermined amount. Reconfiguring the tool to the third configuration may be useful in establishing or re-establishing a predetermined relative position between selectively rotatable portion/s and drive portion/s.

According to an aspect of the invention there is provided a downhole tool sleeve for transmitting torque downhole, the sleeve being coaxially mountable with a second sleeve and comprising a sleeve coupling portion for engagement with a coupling portion of the second sleeve for transmitting a torque between the sleeves;

wherein the sleeve coupling portion is configured to prevent the transmission of torque above a predetermined torque threshold.

According to an aspect of the invention there is provided a coupling arrangement for a downhole tool comprising:

a rotatable inner sleeve comprising an inner sleeve coupling portion;

a rotatable outer sleeve mounted coaxially with the inner sleeve and comprising an outer sleeve coupling portion for forming an interengaging coupling arrangement with the inner sleeve coupling portion for transmitting a torque between the inner and outer sleeves;

wherein the coupling arrangement is configured to prevent the transmission of torque above a predetermined torque threshold.

The coupling arrangement may be configured to permit the transmission of torque when the torque falls below the predetermined torque threshold.

The coupling arrangement may be configured to allow or enable the transmission or retransmission of torque when the torque or torque differential falls below the predetermined threshold. The tool may be configured to allow or enable engagement and/or re-engagement of the coupling portions, such as when the torque or torque differential falls below the predetermined threshold. The tool may be configured to engage and/or re-engage the coupling portions, such as when the torque or torque differential falls below the predetermined threshold.

The sleeve coupling portions may be relatively axially movable. The sleeve coupling portions may be relatively axially movable between a first configuration whereby the inner and outer sleeve coupling portions are axially misaligned to prevent transmission of torque between the inner and outer sleeves, and a second configuration whereby the inner and outer sleeve coupling portions are axially aligned to permit a transmission of torque between the inner and outer sleeves.

Alternatively, the inner and outer sleeve coupling portions may be substantially axially fixed relative to each other. The coupling portions may be substantially permanently axially aligned.

The tool may be reconfigurable between a first configuration whereby the inner and outer sleeve coupling portions are axially misaligned to prevent transmission of torque between the inner and outer sleeves, and a second configuration whereby the inner and outer sleeve coupling portions are axially aligned to permit a transmission of torque between the inner and outer sleeves.

According to an aspect of the invention there is provided a downhole tool comprising a coupling portion according to any of the previous aspects.

According to an aspect of the invention there is provided a directional drilling tool for use in downhole directional drilling, the directional drilling tool comprising:

a drill bit;

a rotatable portion selectively rotatable to steer the directional drilling tool;

a drive portion connected to the drill bit to rotate the drill bit; and a coupling arrangement between the drive portion and the rotatable portion to selectively transmit torque to the rotatable portion;

wherein the coupling arrangement comprises a torque limiter.

The torque limiter may prevent the transmission of torque above a predetermined torque threshold.

The coupling arrangement may comprise a clutch.

The coupling arrangement may be interengaging.

The coupling arrangement may be fluid actuated. The rotatable portion may be a sleeve. The drive portion may be a sleeve. The rotatable and drive portions may be coaxially mounted. The rotatable and drive portions may be concentrically mounted.

According to an aspect of the invention there is provided a method of directional drilling comprising:

providing a directional drilling tool comprising a drill bit, a rotatable portion selectively rotatable to steer the directional drilling tool, a drive portion connected to the drill bit to rotate the drill bit, a coupling arrangement between the drive portion and the rotatable portion to selectively transmit torque to the rotatable portion, and a torque limiter;

rotatably driving the drill bit to drill a bore in a first direction;

selectively coupling the drive portion to the rotatable portion;

transmitting torque from the drive portion to rotate the rotatable portion to steer the drilling tool in a second direction;

limiting the torque transmitted to the rotatable portion with the torque limiter.

According to an aspect of the invention there is provided a steerable downhole tool comprising:

a driven portion;

a rotatable portion selectively rotatable to steer the tool;

a drive portion connected to the driven portion to rotate the driven portion; and a coupling arrangement between the drive portion and the rotatable portion to selectively transmit torque to the rotatable portion;

wherein the coupling arrangement comprises a torque limiter.

The invention includes one or more corresponding aspects, embodiments or features in isolation or in various combinations whether or not specifically stated (including claimed) in that combination or in isolation. For example, it will readily be appreciated that features recited as optional with respect to the first aspect may be additionally applicable with respect to the other aspects without the need to explicitly and unnecessarily list those various combinations and permutations here (e.g. the coupling portion of one aspect may comprise features of any other aspect). Optional features as recited in respect of a method may be additionally applicable to an apparatus; and vice versa.

In addition, corresponding means for performing one or more of the discussed functions are also within the present disclosure.

It will be appreciated that one or more embodiments/aspects may be useful in selectively transmitting rotation downhole and/or preventing transmission of an excessive torque.

As used herein, the term "comprise" is intended to include at least: "consist of"; "consist essentially of"; "include"; and "be". For example, it will be appreciated that where the coupling arrangement may "comprise a torque limiter", the coupling arrangement may "include a torque limiter" (and optionally other element/s); the coupling arrangement "may be a torque limiter"; or the coupling arrangement may "consist of a torque limiter"; etc. For brevity and clarity not all of the permutations of each recitation of "comprise" have been specifically stated.

The above summary is intended to be merely exemplary and non-limiting.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
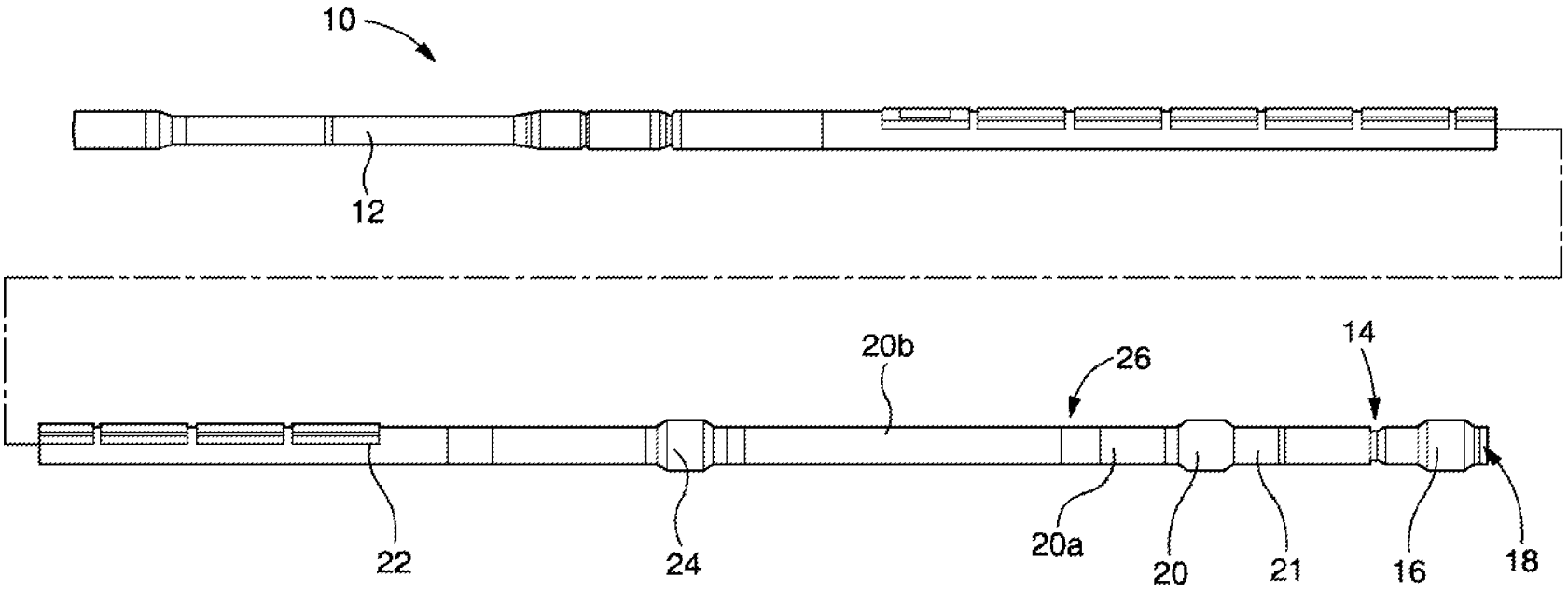
FIG. 1 shows a downhole tool in accordance with a first embodiment of the invention.

Reference is first made to FIG. 1 of the drawings, which illustrates a directional drilling tool for use in drilling a deviated bore, in accordance with an embodiment of the present invention. The tool 10 is mounted to the lower end of a drill string 12, formed of drill pipe sections, and includes a mandrel 14 having a following end coupled to the drill string 12 and a leading end coupled to a rotating stabiliser 16, with a drill bit 18 being mounted to the stabiliser 16. Rotatably mounted on the mandrel 14 are a primary offset stabiliser 20, an eccentric mass 22, and a secondary concentric stabiliser 24. Accordingly, in use, during a drilling operation, the drill string 12 is rotated from surface, which in turn rotates the mandrel 14, stabiliser 16 and drill bit 18. However, the offset stabiliser 20, the concentric stabiliser 24 and the mass 22 are intended to remain substantially stationary in the bore, other than to advance axially with the rest of the apparatus, that is the stabilisers 20, 24 and the mass 22 do not rotate with the drill bit 18.

The tool 10 is utilised in directional drilling and permits the drill bit 18 to be directed to drill in a selected direction; to the side, upwards or downwards. This is achieved by arranging the primary offset stabiliser 20 to offset the mandrel 14, and thus the drill bit 18, in the bore towards the desired drilling direction. The desired offset or orientation of the stabiliser 20 is maintained by coupling the stabiliser 20 to the mass 22, which features a centre of gravity spaced from the mandrel axis, such that the mass 22 tends to lie towards the low side of the bore. The weight of the mandrel 14, drill string 12, and any apparatus and tools mounted on the drill string 12, similarly contribute to maintaining the desired offset of the stabiliser 20.

The orientation of the offset provided by the stabiliser 20, and thus the drilling direction, may be varied by changing the relative orientation of the stabiliser 20 and the mass 22. This variation in orientation of the offset stabiliser 20 is achieved by means of a drive assembly 26 which may be configured such that rotation of the drill string 12 and mandrel 14 is selectively translated to rotation of the stabiliser 20 relative to the mass 22. The offset stabiliser 20 can effectively generate a three point arc when viewing a longitudinal profile, with the offset stabiliser 20 providing a middle point of contact with the bore wall between other points of contact with the drill bit 18 and the concentric stabiliser 24. Accordingly, the drill bit 18 can be angled relative to the longitudinal axis of the drill string. The angle of deviation can be predetermined by the relative axial positioning of the stabilisers 20, 24 and the drill bit; and by the amount of offset of the stabiliser 20. For example, the angle may provide for a deviation of 3 degrees per 100 feet (30 meters)

Figure 2:
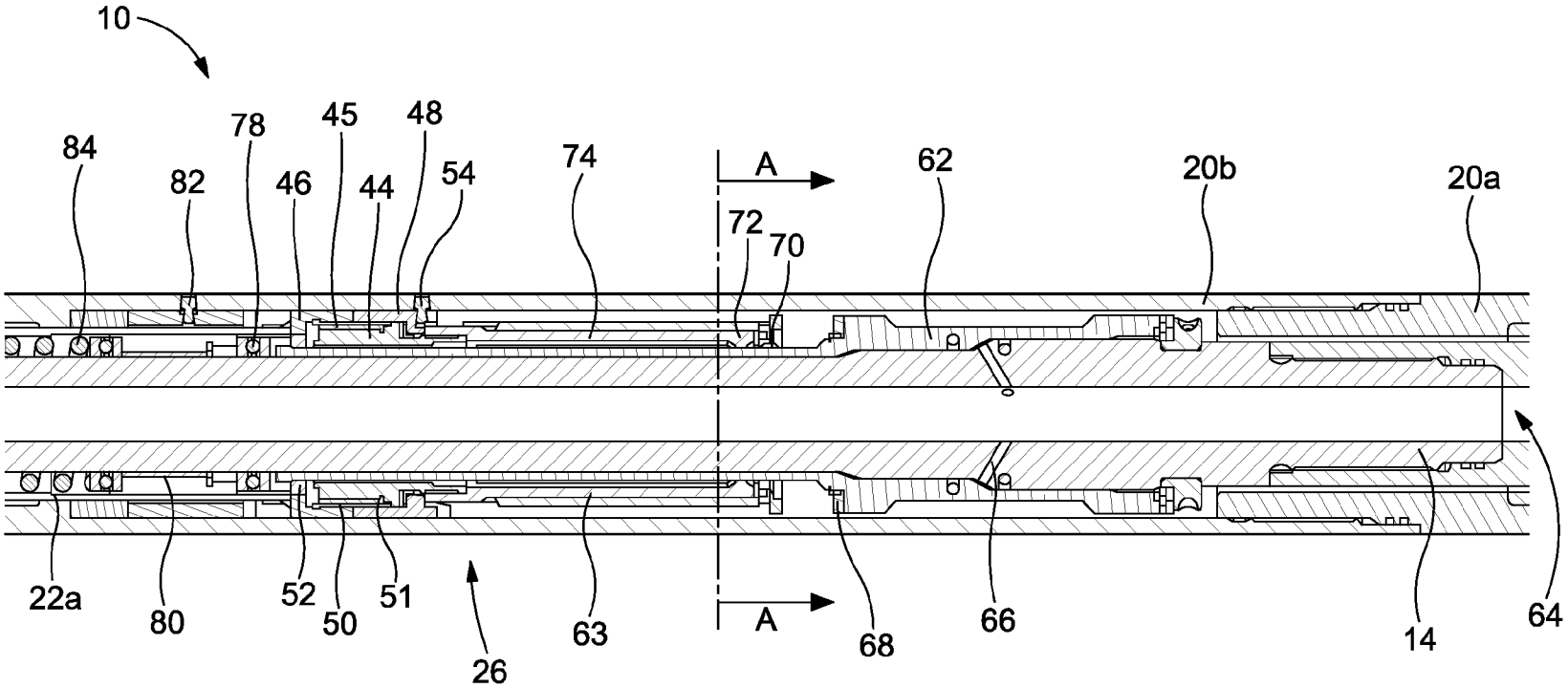
FIG. 2 shows a longitudinal cross-section of a portion of the tool of FIG. 1.
Figure 3:
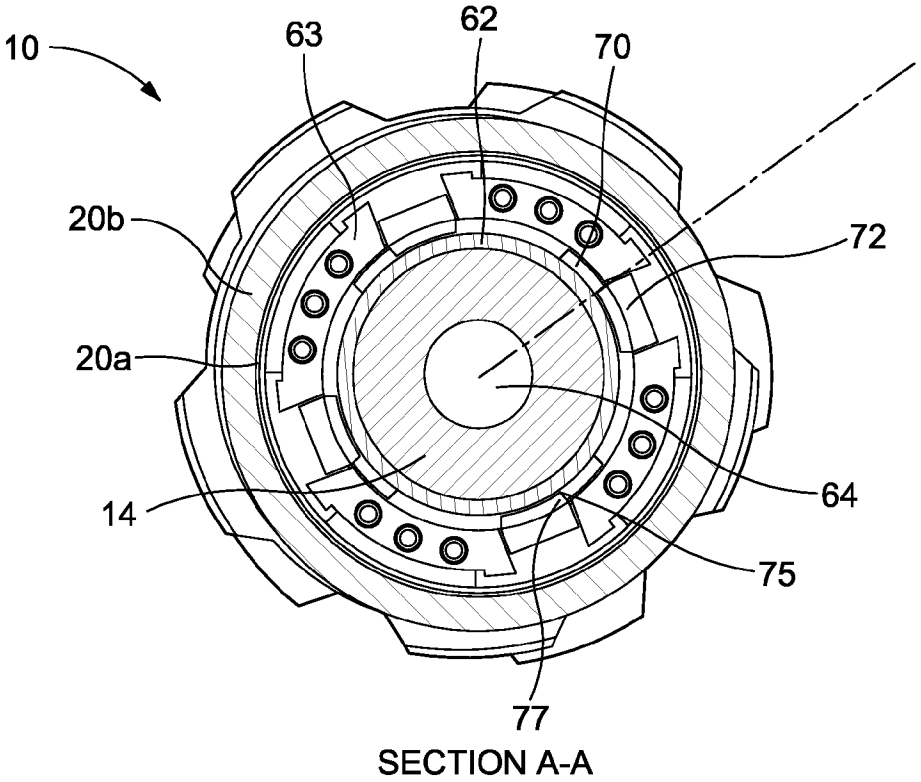
FIG. 3 shows an axial cross-section of a portion of the tool of FIG. 1 taken through line A-A of FIG. 2.
Figure 4:
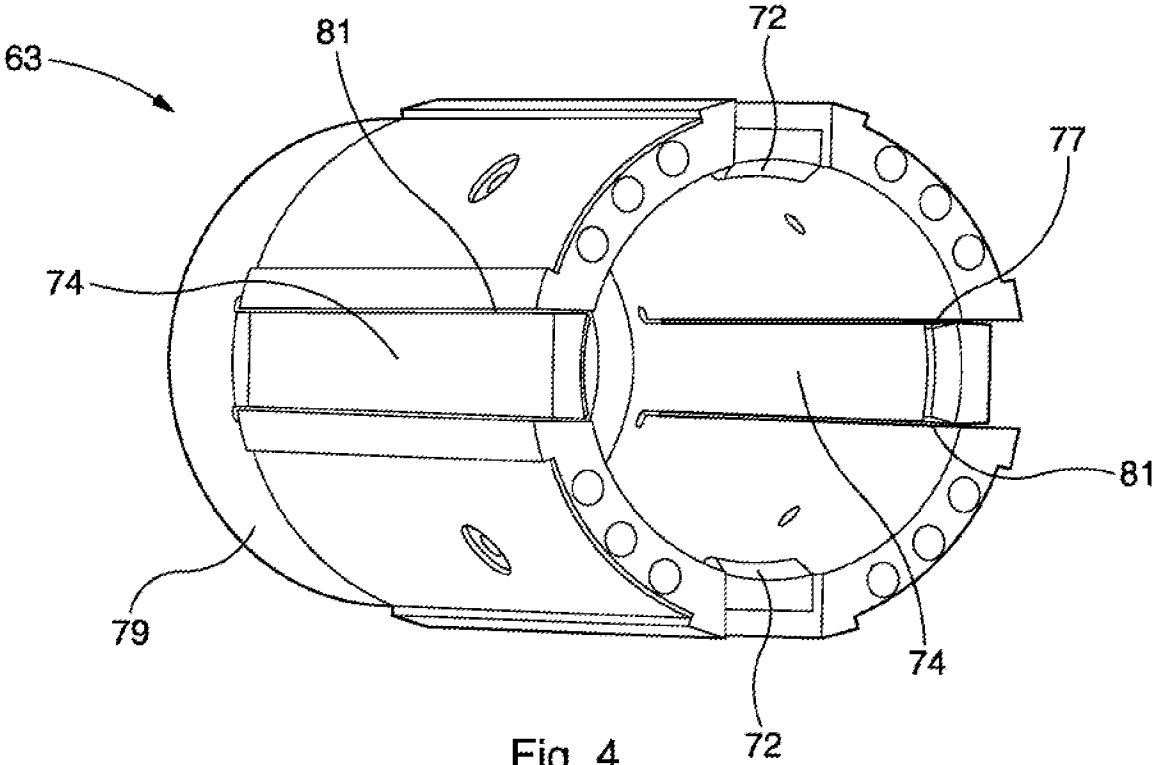
FIG. 4 shows a view of an outer sleeve of the tool of FIG. 1, shown in isolation.

Reference will now be made to FIGS. 2 through 4 of the drawings, which illustrate the drive assembly 26 of the tool of FIG. 1 in greater detail. Reference is first made to FIG. 2 of the drawings, which illustrates the relative positioning of the elements of the drive assembly 26 with the tool inactive (e.g. not pressurised, or in a third configuration), with the relative locations of the stabiliser 20 and mass 22 fixed and the mandrel 14 rotating freely relative to the stabiliser 20 and mass 22. The figure illustrates the mandrel 14 passing through the assembly 26, which includes stabiliser sleeves 20*a*, 20*b* forming part of the stabiliser 20, an offset stabiliser sleeve housing 21, and a mass sleeve 22*a* which is coupled to the mass 22.

The drive assembly 26 includes the elements of the drive, including an inner drive ring 44 and outer driven gear cups 46, 48 which are rotatably coupled to the mass sleeve 22*a* and the stabiliser sleeve 20*b*, respectively. Located between the drive ring 44 and the outer driven gear cups 46, 48 is a toothed flexible gear ring 50. The drive ring 44 includes a slight ovality and the outer driven gears cups 46, 48 have a different number of inner gear teeth, such that rotation of the drive ring 44, transferred via the flexible gear ring 50, results in relative rotation of the outer driven cups 46, 48, and thus rotation of the stabiliser 20 relative to the mass 22. In the embodiment shown, the outer sleeve 63 is attached to the drive gear ring 44 with a threaded connection. The flexible gear ring 50 is mounted on the drive gear ring 44 via needle roller bearings 45. The mass outer driven cup 46 is coupled to the mass sleeve 22*a* by castellations 52, while the stabiliser outer driven cup 48 is coupled to the stabiliser sleeve 20*b* with a pin and hole arrangement 54.

In the embodiment shown, the tool 10 is reconfigurable between a first configuration for drilling and a second configuration for orienting. The tool 10 is further reconfigurable to a third configuration for setting or resetting the tool 10 in a predetermined neutral position (e.g. with steerable portions in predetermined alignment).

The first configuration (similar to that shown for the embodiment in FIG. 8) of the tool 10 is a drilling configuration with an outer sleeve coupling portion with collet drive teeth 72 disengaged from an inner sleeve coupling portion with spline drive teeth 70 (e.g. axially displaced for there being no drive from the inner sleeve 62 to the outer sleeve 63). In this configuration pressure drop is applied by flowing through drill-bit nozzles, in the embodiment shown. The offset stabilizer housing 21 has been oriented to a correct position for drilling in the desired direction (e.g. curved to the left). The mass 22 hangs on a low side of the hole, with an orientation key fully out of slot and not touching an orientation ring.

The second configuration (shown in FIG. 3 and similar to that shown for the embodiment in FIG. 9) of the tool 10 is an orienting configuration where the teeth 70 of the inner sleeve 62 are axially aligned with the teeth 72 of the outer sleeve 63; and is described in more detail hereinafter.

The third configuration of FIG. 2 can be used for the tool 10 at rest, such as supplied to a rigsite. The third configuration can be used to reset the tool 10 to a known position of the offset stabilizer 20. For example, in the third configuration, the offset stabilizer 20 may be aligned with the mass 22. Accordingly, the third configuration can provide a datum position downhole, where a position of the mass 22 (e.g. low side of hole) is known and a position of the offset stabilizer 20 is known relative to the mass 22. Accordingly, the third configuration can provide a datum or reset configuration, if for example, there is uncertainty over a position of the offset stabiliser 20.

In the third configuration as illustrated in FIG. 2, it is the intention that there should be no relative rotation between the stabiliser 20 and the mass 22. The coupling portion of spaced teeth 70 provided on the inner sleeve 62 is spaced from (e.g. downhole of) the coupling portion with corresponding teeth 72 provided on the outer sleeve 63. Similarly, in drilling mode it is the intention that there should be no relative rotation between the stabiliser 20 and the mass 22. The tool 10 comprises a throughbore. In drilling mode, the pressure of the fluid in the mandrel bore 64 provides pressure to the piston 68, such that the inner sleeve 62 is moved uphole (to the left of the position in FIG. 2) so that the spaced teeth 70 provided on the inner sleeve 62 are spaced from (e.g. uphole of) corresponding teeth 72 provided on the outer sleeve 63 (i.e. configured to a first configuration with the coupling portions axially misaligned).

When desired, rotation of the mandrel 14 is transferred to the drive ring 44 via a pressure responsive inner sleeve 62 mounted on the mandrel 14 and an outer sleeve 63 mounted coaxially with the inner sleeve 62. However, during a normal drilling operation, when the mandrel bore 64 is occupied by pressurised drilling fluid, fluid ports 66 in the mandrel wall communicate drilling fluid pressure to a piston 68 defined by the inner sleeve 62 and urges the inner sleeve 62 into a position in which circumferentially spaced teeth 70 provided on the inner sleeve 62 are spaced from corresponding teeth 72 provided on the outer sleeve 63 (i.e. the first configuration). The teeth 72 on the outer drive sleeve 63 are provided at end portions of fingers 74, acting as collet fingers. The lower end of the inner sleeve 62 features axial slots which co-operate with pins formed on the mandrel 14, and which therefore allow transfer of rotation from the mandrel 14 to the inner sleeve 62. The upper end of the inner sleeve 62 abuts, via a bearing 78, a collar 80 on the mandrel which carries a spring pin 82. The collar 80 is urged downwardly relative to the mass sleeve 22*a* by a spring 84. In the first configuration, during a drilling operation, and in the presence of pressurised drilling fluid in the mandrel bore 64, the inner sleeve 62 pushes the collar 80 upwardly against the spring 84.

When it is desired to provide relative rotation between the inner and outer sleeves 62, 63, pressure of the fluid in the mandrel bore 64 is reduced, thus reducing the pressure of the piston 68. In the absence of elevated drilling fluid pressure, the inner sleeve 62 is urged downwards by the spring 84 to locate the inner sleeve teeth 70 in engagement with the outer sleeve teeth 72, to the second configuration of the tool 109 as shown in FIG. 3). The tool 10 is reconfigurable between the first and second configurations without requiring rotational alignment of the inner and outer sleeve coupling portions. The coupling portions are engageable substantially independently of relative rotational positions of the inner and outer sleeves 62, 63. The drive assembly 26 is thus engaged and rotation of the inner sleeve 62 will rotate the outer sleeve 63. In the illustrated embodiment the number of teeth on the drive ring 44 and driven cups 46, 48 are selected such that one hundred and twenty rotations of the mandrel 14 will produce one complete (360°) rotation of the stabiliser 20 relative to the mass 22. Accordingly, if the mandrel 14 is now rotated, the corresponding rotation of the inner sleeve 62 is transferred to the outer sleeve 63 and thus produces relative rotation of the mass sleeve 22*a* and the stabiliser sleeve 20*b*, such that the offset stabiliser 20 will rotate relative to the mass 22 with a gear ratio 120:1 reduction of speed in the embodiment shown.

Reference is now made to FIG. 3, in which the tool 10 is shown in the second configuration. FIG. 3 is an axial cross-section looking downhole, as indicated by the line and arrows "A" in FIG. 2. It is the intention that there should be relative rotation between the stabiliser 20 and the mass 22. Accordingly the inner sleeve 62 is axially aligned with the outer sleeve 63 and respective teeth 70, 72 of the inner and outer sleeves 62, 63 are in contact to transmit torque between the sleeves. In the view shown in FIG. 3, the clockwise rotation of the inner sleeve 62 is transferred to a clockwise rotation of the outer sleeve 63. The teeth 70, 72 comprise bearing surfaces 75, 77 for interengaging contact. The bearing surface 77 of the outer sleeve 63 comprises an offset angle from radial. Accordingly a portion of the torque transferred from the bearing surface of the inner sleeve 62 is converted into a non-tangential force. The non-tangential force urges the teeth 72 of the outer sleeve 63 outwards. Whilst the torque remains below a predetermined threshold, the non-tangential force is insufficient to move the outer teeth 72 outwards. The non-tangential force rises proportionately with the torque. At a torque threshold, the non-tangential force is sufficient to overcome the friction between the bearing surfaces 75, 77 and the stiffness of the fingers 74 such that the teeth 72 move outwards; out of engagement with the teeth 70 of the inner sleeve 62. Accordingly, the teeth 72 form a torque limiter. Accordingly, drive is no longer transmitted to the outer sleeve 63; or the drive ring 44; or the driven gear cups 48, 46; or the mass 22. The inner sleeve 62 rotates substantially unimpeded by the outer sleeve 63. Limiting the amount of torque may prevent damage; such as to the gear teeth of either of the gear cups 46, 48.

In the embodiment shown in FIG. 3, the bearing surfaces 75 of the teeth 70 of the inner sleeve 62 are substantially radial, with an offset of around 8.5 degrees from radial.

The respective teeth 70, 72 of the inner and outer sleeves 62, 63 can be re-engaged by reducing the torque of the inner sleeve 62 below the torque threshold. The resilience of the fingers 74 will urge the teeth 72 back into a coupling engagement with the teeth 70 of the inner sleeve 62. The inner and outer sleeve coupling portions (e.g. the splines or teeth 70, 72) automatically engage or re-engage in the second configuration when the torque is or falls below the predetermined torque threshold. The inner sleeve 62 can be moved by altering the fluid pressure to prevent axial alignment if it is no longer desired to transmit torque to the outer sleeve 63.

FIG. 4 shows a view of the outer sleeve 63 in isolation. The bearing surfaces 77 at the ends of the fingers 74 are shown. The fingers 74 are thinner than a body portion 79 of the sleeve 63. The holes on the end face are to house dowel pins and coil springs. The bearing surfaces 77 are the angled faces on the sides of the four castellations protruding into the centre of the sleeve 63. In the embodiment shown, the drive side is only ever on one side of the teeth 72 as all rotation of the main mandrel 14 is clockwise looking downhole. The straight collet fingers 74 are bent outwards radially and slightly sideways as torque is applied. The fingers 74 are designed to disengage the teeth 72 from teeth 70 of the inner sleeve 62 before the fingers 74 close up gaps 81 between the fingers 74 and the body portion 79.

The fingers 74, teeth 72, bearing surfaces 77, and body portion 79 are all integrally formed. In the embodiment shown, the teeth 72 are configured to disengage at a maximum torque of 50 ft-lbs for a 4¾" downhole application. In alternative embodiments, the maximum torque may be varied. For example, for a 6½" application, the maximum torque may be 100 ft-lbs.

Figure 5:
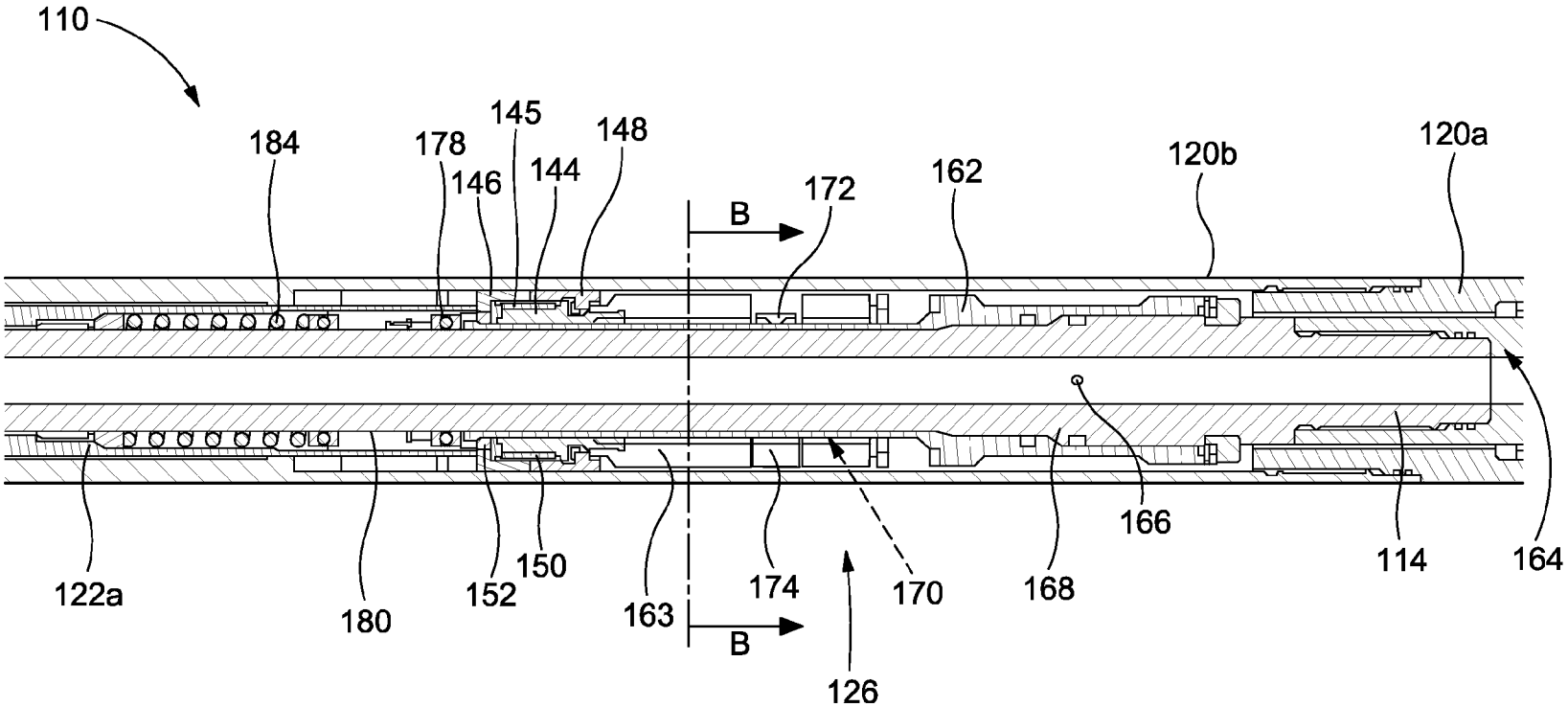
FIG. 5 shows a longitudinal cross-section of a portion of a tool according to a second embodiment of the invention.

FIG. 5 shows a longitudinal cross-section of a portion of a tool 110 according to a second embodiment of the invention. The tool 110 is generally similar to that shown in FIG. 1, and as such like components share like reference numerals, incremented by 100. Accordingly, the tool 110 comprises an inner sleeve 162 and an outer sleeve 163. It will be appreciated that the tool 110 may be incorporated in a drill string similarly to the tool 10 shown in FIG. 1; and comprise a similar arrangement of stabilisers (not shown in FIG. 5).

The portion of the tool 110 shown in FIG. 5 is generally similar and in a similar configuration to that shown in FIG. 2. However, the fingers 174 are circumferentially arranged around the outer sleeve 163. Although the outer sleeve 163 of FIG. 5 is of similar length to the outer sleeve 63 of FIG. 1 (as can be seen comparing FIG. 5 to FIG. 2), in other embodiments, arranging the finger or fingers circumferentially or helically may enable shorter outer sleeves.

Figure 6:
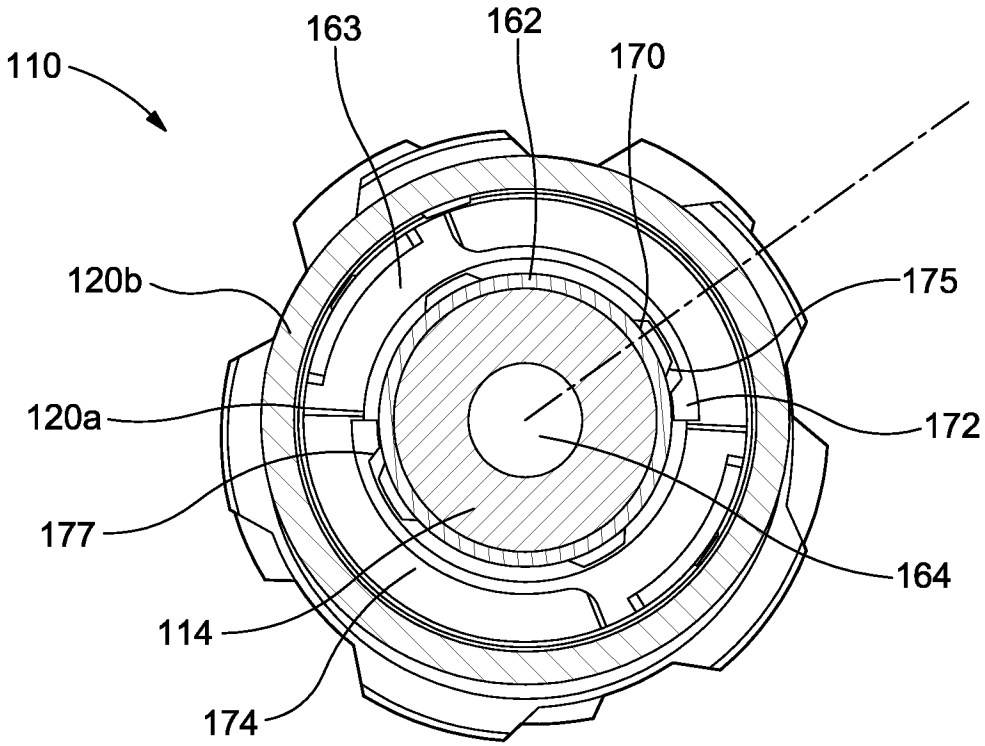
FIG. 6 shows an axial cross-section of a portion of the tool of FIG. 5 taken through line B-B of FIG. 5.

Reference is now made to FIG. 6, in which the tool 110 is shown in a second configuration. FIG. 6 is an axial cross-section looking downhole, as indicated by the line and arrows "B" in FIG. 5. The teeth 170, 172 of the respective inner and outer sleeves 162, 163 are axially aligned. However, the teeth 170, 172 are shown with a small circumferential separation to aid clarity. To transmit torque, the inner sleeve 162 is rotated further clockwise into engagement with the teeth 172 of the outer sleeve 163. In the view shown in FIG. 6, the clockwise rotation of the inner sleeve 162 is transferred to a clockwise rotation of the outer sleeve 163. The teeth 170, 172 comprise bearing surfaces 175, 177 for interengaging contact. The bearing surfaces 177 of the outer sleeve 179 comprise an offset angle from radial. In the embodiment shown, the bearing surfaces 175 of the teeth 170 of the inner sleeve 162 comprise an offset angle, which is a corresponding offset angle to the bearing surfaces 177 of the teeth 172 of the outer sleeve 163. As with the embodiment of FIG. 3, a portion of the torque transferred from the bearing surface 175 of the inner sleeve 162 is converted into a non-tangential force in the teeth 172 of the outer sleeve 163; and, at a torque threshold, the non-tangential force is sufficient to overcome the friction between the bearing surfaces 175, 177 and the stiffness of the fingers 174 such that the teeth 172 move outwards; out of engagement with the teeth 170 of the inner sleeve 162. Accordingly, the coupling arrangement of the bearing surfaces 175 of the teeth 170 of the inner sleeve 162 and the bearing surfaces 177 of the teeth 172 of the outer sleeve 163 form a torque limiter. Accordingly, drive is no longer transmitted to the outer sleeve 163; or the drive ring 144; or the driven gear cups 148, 146; or the mass 122. The inner sleeve 162 rotates substantially unimpeded by the outer sleeve 163.

Figure 7:
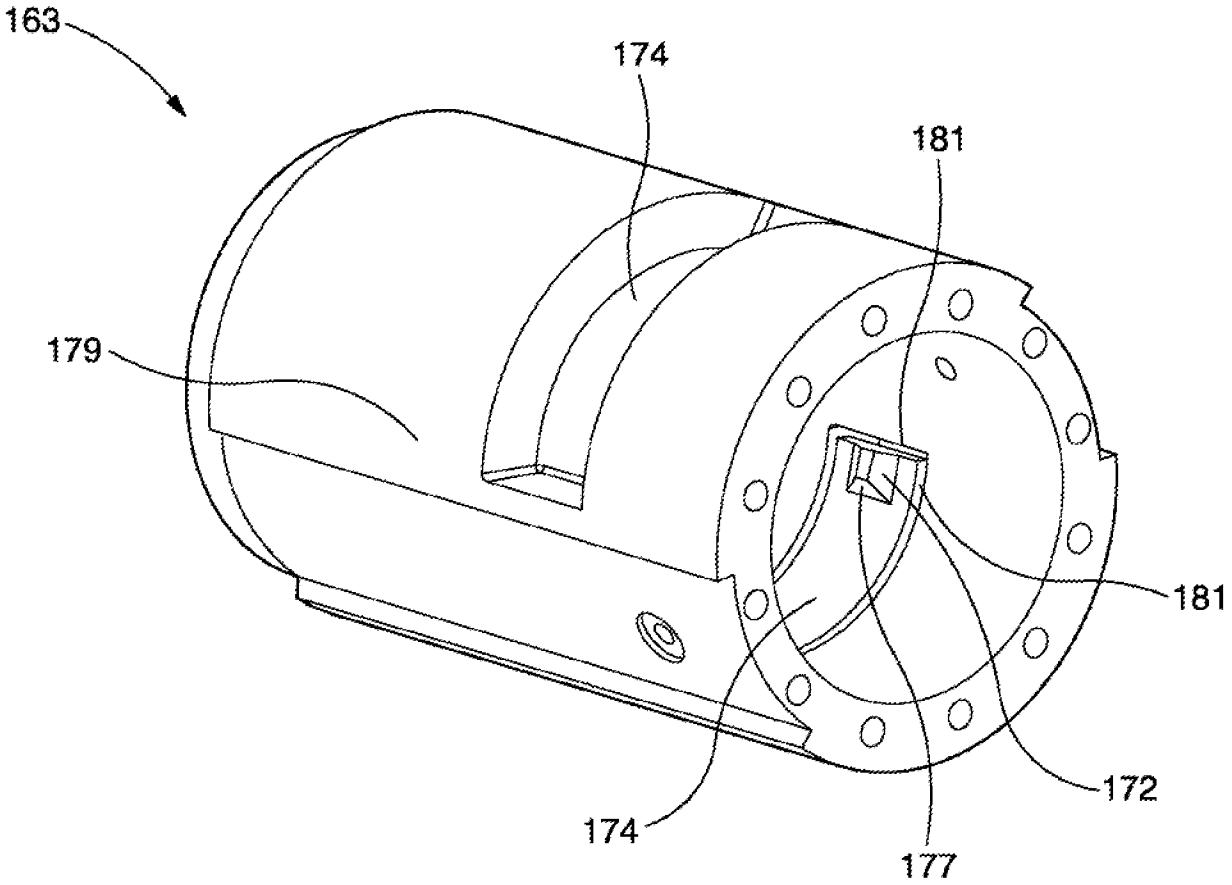
FIG. 7 shows a view of an outer sleeve of the tool of FIG. 5.

FIG. 7 shows a view of the outer sleeve 163 of the tool of FIG. 5; generally similar to the view of the outer sleeve 63 of FIG. 4. The fingers 174, teeth 172, bearing surfaces 177, and body portion 179 are all integrally formed. In the embodiment shown, the teeth 172 are configured to disengage at a maximum torque of 50 ft-lbs, for a 4¾" downhole application.

Figure 8:
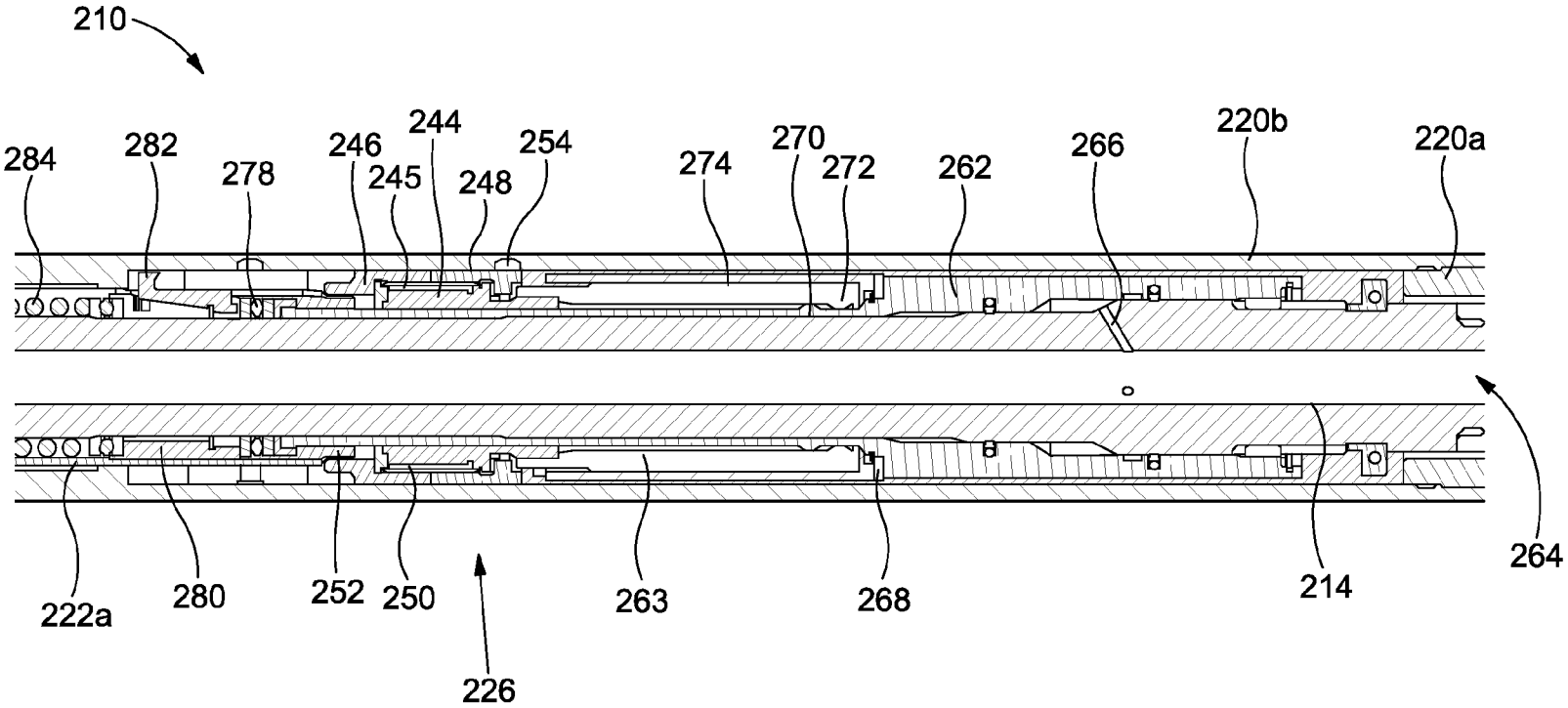
FIG. 8 shows a longitudinal cross-sections of a portion of a tool according to a third embodiment of the invention with the tool in a first configuration.
Figure 9:
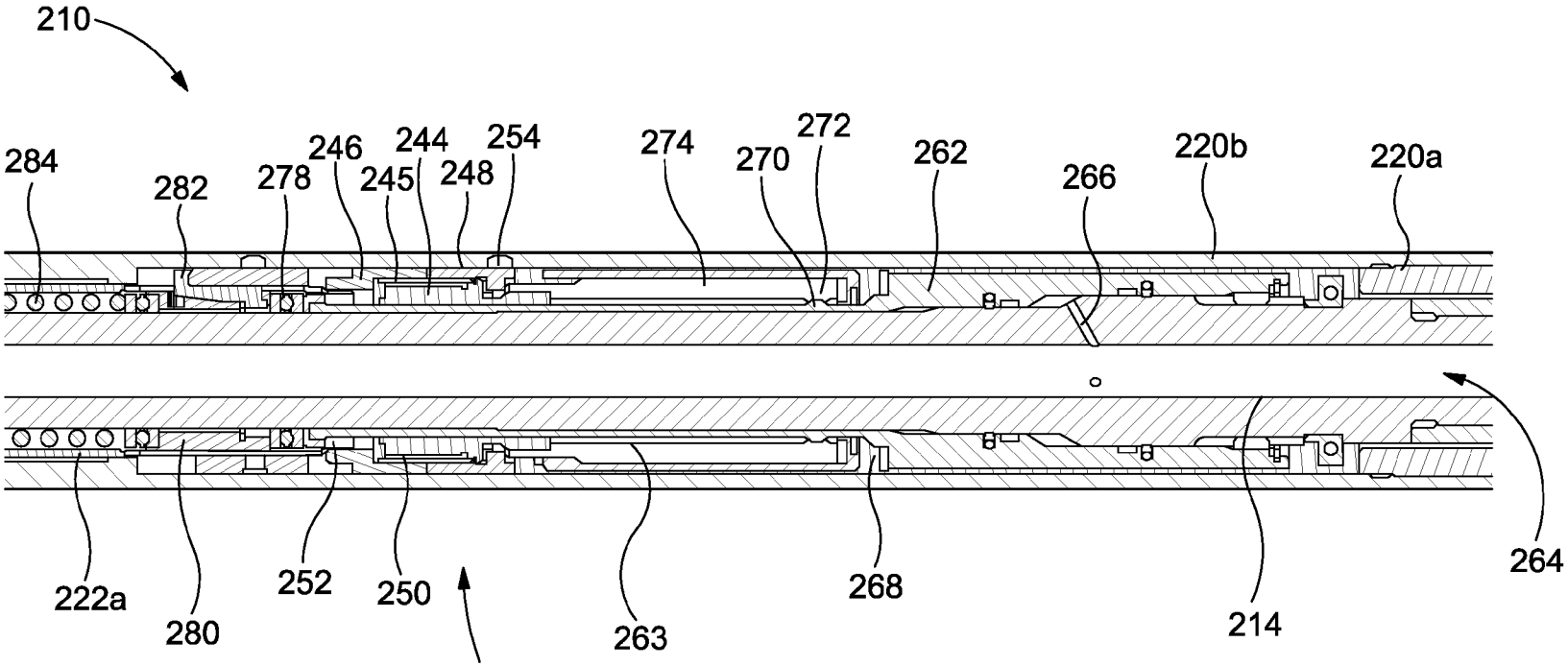
FIG. 9 shows a longitudinal cross-section of the portion of the tool of FIG. 8 in a second configuration.
Figure 10:
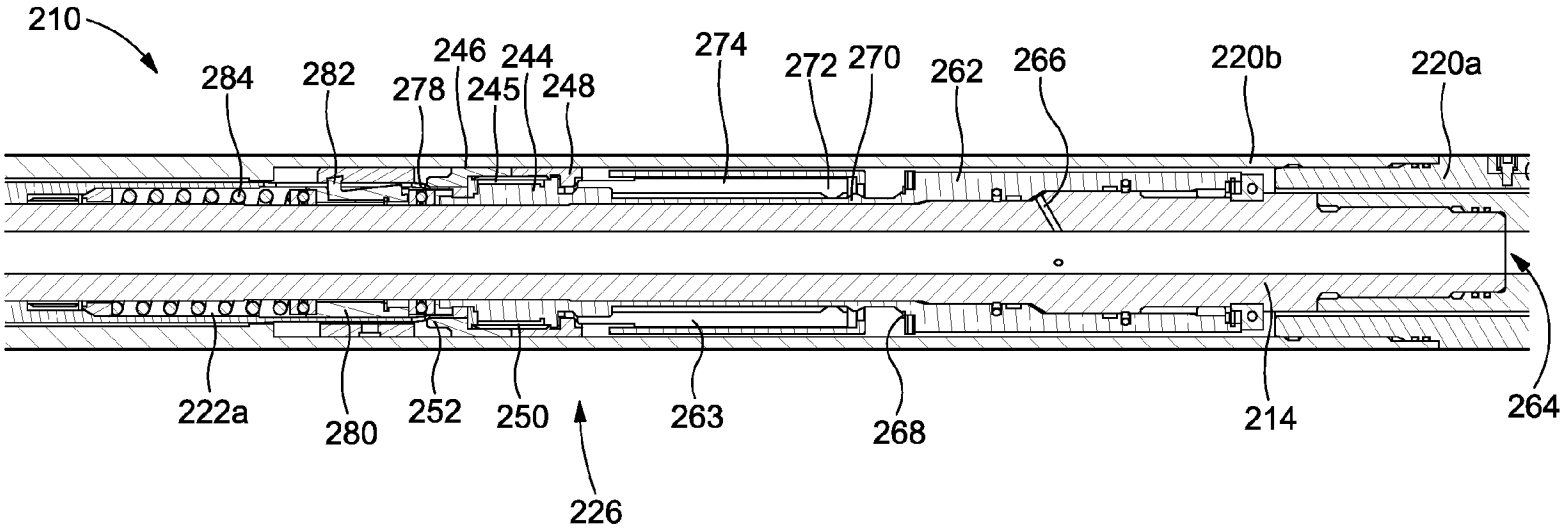
FIG. 10 shows a longitudinal cross-section of the portion of the tool of FIG. 8 in a third configuration.

FIGS. 8, 9 and 10 show longitudinal cross-sections of a portion of a tool 210 according to a third embodiment of the invention. The tool 210 is generally similar to that shown in FIG. 1, and as such like components share like reference numerals, incremented by 200. Accordingly, the tool 210 comprises an inner sleeve 262 and an outer sleeve 263. It will be appreciated that the tool 210 may be incorporated in a drill string similarly to the tool 10 shown in FIG. 1; and comprise a similar arrangement of stabilisers (not shown in FIGS. 8, 9 and 10). The drive assembly 226 is generally similar to that shown in FIGS. 2 to 4, with similar features denoted by similar reference numerals, also incremented by 200.

FIG. 8 shows the tool 210 in a first configuration, which is a drilling configuration of the embodiment shown. Fluid may be pumped down the throughbore 264 and a drill bit (not shown) rotated to drill a bore. The coupling arrangement of the teeth 270, 272 of the inner and outer sleeves 262, 263 is misaligned such that torque is not transmitted between the inner and outer sleeves 262, 263. In the embodiment shown, the teeth 72 of the outer sleeve 263 are located downhole of the teeth 270 of the inner sleeve 262 in the first configuration of FIG. 8.

FIG. 9 shows the tool 210 in a second configuration, which is an orienting configuration of the tool 210 of the embodiment shown (similar to the configuration of the tool 10 of FIG. 3), where the teeth 270 of the inner sleeve 262 are axially aligned with the teeth 272 of the outer sleeve 263. The tool 210 is reconfigured from the first configuration of FIG. 8 to the second configuration similarly as to the reconfiguration of the tool 10 above of to the second configuration of FIG. 3. It is the intention that there should be relative rotation between the stabiliser 220 and the mass 222. Accordingly the inner sleeve 262 is axially aligned with the outer sleeve 263 and respective teeth 270, 272 of the inner and outer sleeves 262, 623 are in contact to transmit torque between the sleeves FIG. 10 shows the tool 210 in a third configuration, which is a neutral or resting configuration of the tool 210 of the embodiment shown (similar to the configuration of the tool 10 of FIG. 2). The third configuration can be used for the tool 210 at rest, such as during transit. The third configuration can be used to reset the tool 210 to a known position of the offset stabilizer 220. For example, in the third configuration, the offset stabilizer 220 may be aligned with the mass 222. Accordingly, the third configuration can provide a datum position downhole, where a position of the mass 222 (e.g. low side of hole) is known and a position of the offset stabilizer 220 is known relative to the mass 222. Accordingly, the third configuration can provide a datum or reset configuration, if for example, there is uncertainty over a position of the offset stabiliser 220.

In the third configuration as illustrated in FIG. 10, it is the intention that there should be no relative rotation between the stabiliser 220 and the mass 222. The coupling portion of spaced teeth 270 provided on the inner sleeve 262 is spaced from (e.g. downhole of) the coupling portion with corresponding teeth 272 provided on the outer sleeve 263. Similarly, in drilling mode it is the intention that there should be no relative rotation between the stabiliser 220 and the mass 222. It should be noted that the particular circumferential arrangement of the teeth 270, 272 and/or the resilient nature of the fingers 274 may allow the teeth 270, 272 to pass axially, such as in the event of direct reconfiguration between the first and third configurations (e.g. due to an unintended pump activation or deactivation); such as passing axially without drivingly engaging, or substantially without damage.

It will be appreciated that any of the aforementioned apparatus may have other functions in addition to the mentioned functions, and that these functions may be performed by the same apparatus.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. It should be understood that the embodiments described herein are merely exemplary and that various modifications may be made thereto without departing from the scope of the invention. For example, it will be appreciated that where an outer sleeve is shown with radially movable teeth, in alternative embodiments an inner sleeve may comprise radially movable teeth. Similarly, where the inner sleeve is shown as being axially movable, in other embodiments, the outer sleeve may be axially movable; or the sleeves may be relatively axially fixed. It will also be appreciated, that where shown here with a concentric stabiliser downhole of the mass, in alternative embodiments alternative arrangements may be provided (e.g. with an alternative or additional offset stabiliser/s above and/or below the mass). Similarly, where shown here with both axially and radially misalignable coupling portions, it will be appreciated that in other embodiments only one degree of misalignment may be required. For example, in some applications, it may not be necessary to selectively transmit torque such that only one misalignment of a torque limiter may be required.

What is claimed is:

1. A downhole tool comprising:

a rotatable inner sleeve comprising an inner sleeve coupling portion;

a rotatable outer sleeve mounted coaxially with the inner sleeve and comprising an outer sleeve coupling portion for engagement with the inner sleeve coupling portion for transmitting a torque between the inner and outer sleeves;

wherein the tool is reconfigurable between a first configuration whereby the inner and outer sleeve coupling portions are axially misaligned to prevent transmission of torque between the inner and outer sleeves, and a second configuration whereby the inner and outer sleeve coupling portions are axially aligned to permit a transmission of torque between the inner and outer sleeves; and wherein at least one of the inner or outer sleeve coupling portions includes a resilient element configured to prevent the transmission of torque above a predetermined torque threshold when the tool is in the second configuration.

2. The downhole tool of claim 1, wherein the at least one of the inner or outer sleeve coupling portions is configured to prevent engagement of the coupling portions above the predetermined torque threshold.

3. The downhole tool of claim 1, wherein at least one of the inner or outer sleeve coupling portions is configured to disengage the other of the outer or inner sleeve coupling portion at the predetermined torque threshold.

4. The tool of claim 1, wherein the tool is configured to allow or enable engagement and/or re-engagement of the coupling portions, such as when the torque falls below the predetermined threshold.

5. The tool of claim 1, wherein the at least one of the inner or outer sleeve coupling portions is configured to enable the transmission or retransmission of torque when the tool is in the second configuration and the torque falls below the predetermined threshold.

6. The downhole tool of claim 1, wherein the tool is reconfigurable between the first and second configurations without requiring rotational alignment of the inner and outer sleeve coupling portions.

7. The downhole tool of claim 1, wherein the inner and outer sleeve coupling portions automatically engage or re-engage in the second configuration when the torque is or falls below the predetermined torque threshold.

8. The downhole tool of claim 1, wherein the coupling portions are engageable substantially independently of relative rotational positions of the inner and outer sleeves.

9. The downhole tool of claim 1, wherein the inner and outer sleeve coupling portions form an interengaging coupling arrangement for transmitting the torque between the inner and outer sleeves.

10. The downhole tool of claim 1, wherein at least one of the inner or outer sleeve coupling portions is configured to convert at least a portion of the torque into a directional force in a direction other than that of rotation.

11. The downhole tool of claim 10, wherein the directional force comprises a disengaging force at a predetermined magnitude.

12. The downhole tool of claim 1, wherein each coupling portion comprises a bearing surface for contacting the other coupling portion to transfer torque between the sleeves.

13. The downhole tool of claim 12, wherein each bearing surface is arranged at an offset angle.

14. The downhole tool of any preceding claim 12, wherein the bearing surfaces comprise a friction property such that the bearing surfaces slide relative to each other at the predetermined torque.

15. A downhole tool comprising:

a rotatable inner sleeve comprising an inner sleeve coupling portion;

a rotatable outer sleeve mounted coaxially with the inner sleeve and comprising an outer sleeve coupling portion for engagement with the inner sleeve coupling portion for transmitting a torque between the inner and outer sleeves;

wherein the tool is selectively reconfigurable between a first configuration whereby the transmission of torque between the inner and outer sleeves is prevented, and a second configuration whereby the transmission of torque between the inner and outer sleeves is permitted;

wherein at least one of the inner or outer sleeve coupling portions is configured to prevent the transmission of torque above a predetermined torque threshold when the tool is in the second configuration; and wherein at least one of the coupling portions comprises an element being configured to deflect or displace in a substantially radial direction relative to the sleeve, such that the coupling portions disengage at the predetermined torque.

16. The downhole tool of claim 15, wherein the element configured to deflect or displace is oriented in a longitudinal direction.

17. The downhole tool of claim 15, wherein the element configured to deflect or displace is resilient.

18. The downhole tool of claim 15, wherein the element configured to deflect or displace is substantially circumferentially arranged.

19. The downhole tool of claim 15, wherein the torque threshold is at least partially defined by a stiffness of the element configured to deflect or displace.

20. The downhole tool of claim 15, wherein the sleeve coupling portions are integrally formed with the respective sleeves.

21. The downhole tool of claim 15, wherein the inner and/or outer sleeve comprises a plurality of coupling portions distributed around the sleeve.

22. The downhole tool of claim 15, wherein the element configured to deflect or displace is connected to a body portion of the inner or outer sleeve, the body portion being distanced from the element by a separation to permit movement of the element relative to the sleeve body portion, and wherein the sleeve is configured to disengage at the predetermined torque prior to closing of the separation by deflection or deformation of the element.

23. The downhole tool of claim 15, wherein the downhole tool comprises a drilling tool.

24. The downhole tool of claim 15, wherein the coupling arrangement is configured to selectively transfer torque between a drilling drive system and a drilling steering system.

25. A method of selectively transmitting torque between an inner sleeve and an outer sleeve of a downhole tool, the method comprising:

configuring the downhole tool to a first configuration wherein respective coupling portions of the inner and outer sleeves are axially misaligned to prevent the transmission of torque between the inner and outer sleeves in the first configuration;

reconfiguring the downhole tool to a second configuration wherein the respective coupling portions of the inner and outer sleeves are axially aligned to permit the transmission of torque between the inner and outer sleeves in the second configuration;

permitting transmission of torque between the inner and outer sleeves in the second configuration;

deflecting or displacing at least a portion of an element of at least one of the coupling portions in a substantially radial direction relative to the sleeve; and preventing the transmission of torque above a predetermined torque threshold when the tool is in the second configuration.

26. The method of claim 25, wherein the method comprises engaging the coupling portions in the second configuration to transmit torque.

27. The method of claim 25, wherein the method comprises disengaging the coupling portions at the predetermined torque threshold.

28. The method of claim 25, wherein the method comprises re-engaging the coupling portions when the torque falls below the predetermined torque threshold.

29. A directional drilling tool for use in downhole directional drilling, the directional drilling tool comprising:

a drill bit;

a rotatable portion selectively rotatable to steer the directional drilling tool;

a drive portion connected to the drill bit to rotate the drill bit; and a coupling arrangement between the drive portion and the rotatable portion to selectively transmit torque to the rotatable portion;

wherein the coupling arrangement comprises a resilient element configured to deflect or displace in response to torque above a predetermined torque threshold.

30. The tool of claim 29, wherein the coupling arrangement is selectively engageable to selectively transmit torque to the rotatable portion.

31. The tool of claim 29, wherein the coupling arrangement is actuated by a drilling fluid pressure.

32. The tool of claim 29, wherein the rotatable portion comprises a sleeve.

33. The tool of claim 29, wherein the drive portion comprises a sleeve.

* * * * *